US008191623B2

(12) United States Patent
Lynde et al.

(10) Patent No.: US 8,191,623 B2
(45) Date of Patent: Jun. 5, 2012

(54) SLICKLINE CONVEYED SHIFTING TOOL SYSTEM

(75) Inventors: Gerald D. Lynde, Houston, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 188 days.

(21) Appl. No.: 12/423,086

(22) Filed: Apr. 14, 2009

(65) Prior Publication Data

US 2010/0258293 A1 Oct. 14, 2010

(51) Int. Cl.
*E21B 31/20* (2006.01)

(52) U.S. Cl. ..... 166/98; 166/178; 166/301

(58) Field of Classification Search ..... 166/178, 166/301, 98, 381
See application file for complete search history.

(56) References Cited

U.S. PATENT DOCUMENTS 2,949,963 A * 8/1960 McGowen, Jr. et al. ..... 166/317
3,468,258 A 9/1969 Arutunoff
3,552,718 A * 1/1971 Schwegman ..... 251/291
3,981,364 A 9/1976 Warner et al.
4,083,401 A 4/1978 Rankin
4,124,070 A * 11/1978 King et al. ..... 166/255.1
4,392,377 A 7/1983 Rankin
4,493,374 A 1/1985 Magee, Jr.
4,494,608 A 1/1985 Williams et al.
4,671,359 A 6/1987 Renfro
4,924,940 A 5/1990 Burroughs et al.
5,025,861 A * 6/1991 Huber et al. ..... 166/297
5,050,682 A * 9/1991 Huber et al. ..... 166/377
5,095,993 A * 3/1992 Huber et al. ..... 166/382
5,183,114 A * 2/1993 Mashaw et al. ..... 166/319
5,211,241 A * 5/1993 Mashaw et al. ..... 166/320
5,305,833 A * 4/1994 Collins ..... 166/386
5,309,988 A * 5/1994 Shy et al. ..... 166/72
5,318,128 A 6/1994 Johnson et al.
5,327,974 A 7/1994 Donovan et al.
5,355,953 A * 10/1994 Shy et al. ..... 166/250.1
5,375,658 A 12/1994 Schultz et al.
5,392,856 A 2/1995 Broussard, Jr. et al.
5,641,023 A * 6/1997 Ross et al. ..... 166/386
5,819,848 A 10/1998 Rasmuson et al.
6,026,911 A 2/2000 Angle et al.
6,041,857 A 3/2000 Carmody et al.
6,059,030 A 5/2000 Celestine
6,189,617 B1 2/2001 Sorhus et al.
6,189,621 B1 2/2001 Vail, III
6,196,319 B1 3/2001 Henskens et al.
(Continued)

OTHER PUBLICATIONS

"Radio-frequency", http://searchnetworking.techtarget.com/definition/radio-frequency, Jul. 2000, 2 pages.*

(Continued)

*Primary Examiner* — Jennifer H Gay
(74) *Attorney, Agent, or Firm* — Steve Rosenblatt

(57) ABSTRACT

A shifting tool is run on slickline and has an on board power supply. Rotary motion of the motor is converted to linear motion of the shifting tool using a ball screw device. The grip is obtained with longitudinal motion of a grip linkage and an on board jar then can do the shifting. Alternatively a linear motor can be used to extend and retract the grip assembly and shift using the jar tool. Optionally the tool can be anchored and linear motion from the on board power source operating a motor can do the shifting.

11 Claims, 7 Drawing Sheets

U.S. PATENT DOCUMENTS

| | | | | |
|---|---|---|---|---|
| 6,343,649 | B1 * | 2/2002 | Beck et al. | 166/250.01 |
| 6,359,569 | B2 * | 3/2002 | Beck et al. | 340/856.3 |
| 6,397,946 | B1 | 6/2002 | Vail, III | |
| 6,405,798 | B1 | 6/2002 | Barrett et al. | |
| 6,464,012 | B1 | 10/2002 | Strickland | |
| 6,481,505 | B2 * | 11/2002 | Beck et al. | 166/387 |
| 6,497,280 | B2 * | 12/2002 | Beck et al. | 166/250.07 |
| 6,543,538 | B2 | 4/2003 | Tolman et al. | |
| 6,588,505 | B2 * | 7/2003 | Beck et al. | 166/250.17 |
| 6,607,607 | B2 | 8/2003 | Walker et al. | |
| 6,945,330 | B2 | 9/2005 | Wilson et al. | |
| 6,983,795 | B2 * | 1/2006 | Zuklic et al. | 166/51 |
| 7,051,810 | B2 | 5/2006 | Clemens et al. | |
| 7,080,701 | B2 | 7/2006 | Bloom et al. | |
| 7,111,677 | B2 | 9/2006 | St. Clair | |
| 7,121,343 | B2 | 10/2006 | Telfer | |
| 7,150,318 | B2 | 12/2006 | Freeman | |
| 7,152,680 | B2 | 12/2006 | Wilson et al. | |
| 7,325,606 | B1 | 2/2008 | Vail, III et al. | |
| 7,367,397 | B2 * | 5/2008 | Clemens et al. | 166/301 |
| 7,387,165 | B2 * | 6/2008 | Lopez de Cardenas et al. | 166/313 |
| 7,392,859 | B2 | 7/2008 | Mock et al. | |
| 7,467,661 | B2 * | 12/2008 | Gordon et al. | 166/298 |
| 7,556,102 | B2 | 7/2009 | Gomez | |
| 7,617,875 | B2 | 11/2009 | Darnell et al. | |
| 7,878,242 | B2 | 2/2011 | Gray | |
| 2001/0013410 | A1 * | 8/2001 | Beck et al. | 166/65.1 |
| 2001/0013411 | A1 * | 8/2001 | Beck et al. | 166/65.1 |
| 2001/0042617 | A1 * | 11/2001 | Beck et al. | 166/65.1 |
| 2001/0043146 | A1 * | 11/2001 | Beck et al. | 340/855.8 |
| 2004/0045709 | A1 * | 3/2004 | Zuklic et al. | 166/278 |
| 2004/0112587 | A1 | 6/2004 | Van Drentham Susman et al. | |
| 2005/0034874 | A1 | 2/2005 | Guerrero et al. | |
| 2005/0126791 | A1 | 6/2005 | Barbee et al. | |
| 2005/0217861 | A1 | 10/2005 | Misselbrook | |
| 2006/0090900 | A1 * | 5/2006 | Mullen et al. | 166/376 |
| 2006/0108117 | A1 | 5/2006 | Telfer | |
| 2006/0124310 | A1 * | 6/2006 | Lopez de Cardenas et al. | 166/313 |
| 2006/0201716 | A1 | 9/2006 | Bloom et al. | |
| 2007/0151732 | A1 * | 7/2007 | Clemens et al. | 166/301 |
| 2007/0251687 | A1 | 11/2007 | Martinez et al. | |
| 2007/0272411 | A1 * | 11/2007 | Lopez De Cardenas et al. | 166/305.1 |
| 2008/0029276 | A1 | 2/2008 | Templeton et al. | |
| 2008/0251254 | A1 | 10/2008 | Lynde et al. | |
| 2009/0045975 | A1 | 2/2009 | Evans et al. | |
| 2009/0294124 | A1 * | 12/2009 | Patel | 166/255.2 |
| 2009/0301723 | A1 | 12/2009 | Gray | |
| 2010/0108323 | A1 | 5/2010 | Wilkin | |
| 2010/0258289 | A1 * | 10/2010 | Lynde et al. | 166/55.7 |
| 2010/0258293 | A1 * | 10/2010 | Lynde et al. | 166/66 |
| 2010/0258296 | A1 * | 10/2010 | Lynde et al. | 166/105.1 |
| 2010/0258297 | A1 * | 10/2010 | Lynde | 166/105.1 |
| 2010/0258298 | A1 * | 10/2010 | Lynde et al. | 166/173 |
| 2010/0263856 | A1 * | 10/2010 | Lynde et al. | 166/53 |
| 2010/0282475 | A1 * | 11/2010 | Darnell et al. | 166/373 |
| 2010/0288501 | A1 | 11/2010 | Fielder et al. | |
| 2011/0056692 | A1 * | 3/2011 | Lopez de Cardenas et al. | 166/305.1 |
| 2011/0162835 | A1 | 7/2011 | Gray | |

OTHER PUBLICATIONS

TAM International Brochure; "TAM SlikPak Plus", http://www.tamintl.com/imageststories/pdfs/SlikPakPlus_Brochure.pdf; 4 pages, date unknown.

De Jesus, O., et al., "Real-Time Wire Management System Improved Reliability and Efficiency in Slickline Service Operations", SPE 103168, Sep. 2006, 1-14.

McClatchie, D.W., et al., "Coiled Tubing: Extending the Reach of Slickline Operations", SPE 60722, Apr. 2000, 1-6.

Larimore, David R., et al., "Field Cases of Cost Efficient Well Interventions Performed with Advanced Slickline Technology", SPE 38097, Apr. 1997, 597-618.

Arnold, R. Stephen, "Innovations in Slickline Technology", SPE 59710, Mar. 1-5, 2000.

Li, J., et al., "Sand Cleanout with Coiled Tubing: Choice of Process, Tools, or Fluids?", SPE 113267, Jun. 2008, 1-.

Schwanitz, B., "Isolation Valve Contingencies Using Wireline Stroker and Tractor Technologies", SPE 124616, Oct. 2009, 1-6.

* cited by examiner

SLICKLINE CONVEYED SHIFTING TOOL SYSTEM

FIELD OF THE INVENTION

The field of this invention is tools run downhole preferably on cable and which operate with on board power to perform a downhole function and more particularly a downhole shifting tool.

BACKGROUND OF THE INVENTION

It is a common practice to plug wells and to have encroachment of water into the wellbore above the plug. FIG. 1 illustrates this phenomenon. It shows a wellbore 10 through formations 12, 14 and 16 with a plug 18 in zone 16. Water 20 has infiltrated as indicated by arrows 22 and brought sand 24 with it. There is not enough formation pressure to get the water 20 to the surface. As a result, the sand 24 simply settles on the plug 18.

There are many techniques developed to remove debris from wellbores and a good survey article that reviews many of these procedures is SPE 113267 Published June 2008 by Li, Misselbrook and Seal entitled Sand Cleanout with Coiled Tubing: Choice of Process, Tools or Fluids? There are limits to which techniques can be used with low pressure formations. Techniques that involve pressurized fluid circulation present risk of fluid loss into a low pressure formation from simply the fluid column hydrostatic pressure that is created when the well is filled with fluid and circulated or jetted. The productivity of the formation can be adversely affected should such flow into the formation occur. As an alternative to liquid circulation, systems involving foam have been proposed with the idea being that the density of the foam is so low that fluid losses will not be an issue. Instead, the foam entrains the sand or debris and carries it to the surface without the creation of a hydrostatic head on the low pressure formation in the vicinity of the plug. The downside of this technique is the cost of the specialized foam equipment and the logistics of getting such equipment to the well site in remote locations.

Various techniques of capturing debris have been developed. Some involve chambers that have flapper type valves that allow liquid and sand to enter and then use gravity to allow the flapper to close trapping in the sand. The motive force can be a chamber under vacuum that is opened to the collection chamber downhole or the use of a reciprocating pump with a series of flapper type check valves. These systems can have operational issues with sand buildup on the seats for the flappers that keep them from sealing and as a result some of the captured sand simply escapes again. Some of these one shot systems that depend on a vacuum chamber to suck in water and sand into a containment chamber have been run in on wireline. Illustrative of some of these debris cleanup devices are U.S. Pat. No. 6,196,319 (wireline); U.S. Pat. No. 5,327,974 (tubing run); U.S. Pat. No. 5,318,128 (tubing run); U.S. Pat. No. 6,607,607 (coiled tubing); U.S. Pat. No. 4,671,359 (coiled tubing); U.S. Pat. No. 6,464,012 (wireline); U.S. Pat. No. 4,924,940 (rigid tubing) and U.S. Pat. No. 6,059,030 (rigid tubing).

The reciprocation debris collection systems also have the issue of a lack of continuous flow which promotes entrained sand to drop when flow is interrupted. Another issue with some tools for debris removal is a minimum diameter for these tools keeps them from being used in very small diameter wells. Proper positioning is also an issue. With tools that trap sand from flow entering at the lower end and run in on coiled tubing there is a possibility of forcing the lower end into the sand where the manner of kicking on the pump involves setting down weight such as in U.S. Pat. No. 6,059,030. On the other hand, especially with the one shot vacuum tools, being too high in the water and well above the sand line will result in minimal capture of sand.

What is needed is a debris removal tool that can be quickly deployed such as by slickline and can be made small enough to be useful in small diameter wells while at the same time using a debris removal technique that features effective capture of the sand and preferably a continuous fluid circulation while doing so. A modular design can help with carrying capacity in small wells and save trips to the surface to remove the captured sand. Other features that maintain fluid velocity to keep the sand entrained and further employ centrifugal force in aid of separating the sand from the circulating fluid are also potential features of the present invention. Those skilled in the art will have a better idea of the various aspects of the invention from a review of the detailed description of the preferred embodiment and the associated drawings, while recognizing that the full scope of the invention is determined by the appended claims.

One of the issues with introduction of bottom hole assemblies into a wellbore is how to advance the assembly when the well is deviated to the point where the force of gravity is insufficient to assure further progress downhole. Various types of propulsion devices have been devised but are either not suited for slickline application or not adapted to advance a bottom hole assembly through a deviated well. Some examples of such designs are U.S. Pat. Nos. 7,392,859; 7,325,606; 7,152,680; 7,121,343; 6,945,330; 6,189,621 and 6,397,946. US Publication 2009/0045975 shows a tractor that is driven on a slickline where the slickline itself has been advanced into a wellbore by the force of gravity from the weight of the bottom hole assembly.

SUMMARY OF THE INVENTION

A shifting tool is run on slickline and has an on board power supply. Rotary motion of the motor is converted to linear motion of the shifting tool using a ball screw device. The grip is obtained with longitudinal motion of a grip linkage and an on board jar then can do the shifting. Alternatively a linear motor can be used to extend and retract the grip assembly and shift using the jar tool. Optionally the tool can be anchored and linear motion from the on board power source operating a motor can do the shifting.

DETAILED DESCRIPTION OF THE PREFERRED EMBODIMENT

Figure 1:
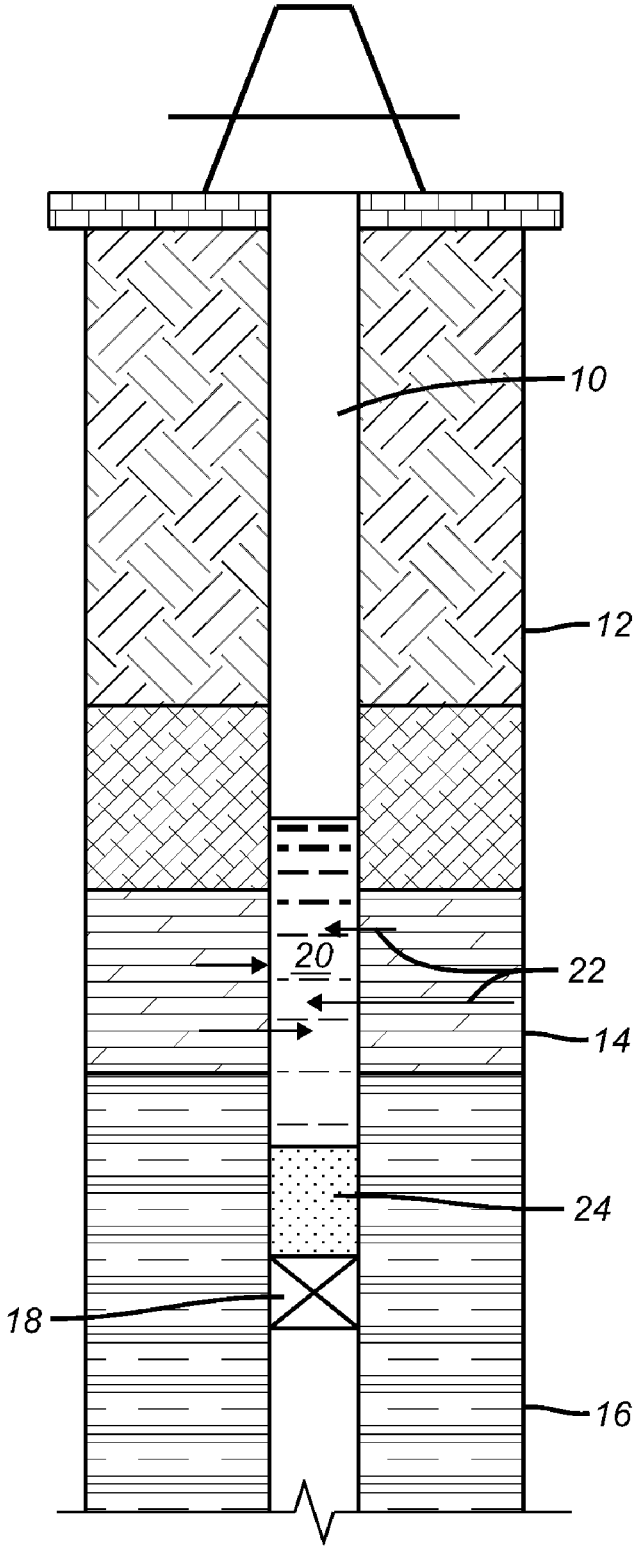
FIG. 1 is a section view of a plugged well where the debris collection device will be deployed.
Figure 2:
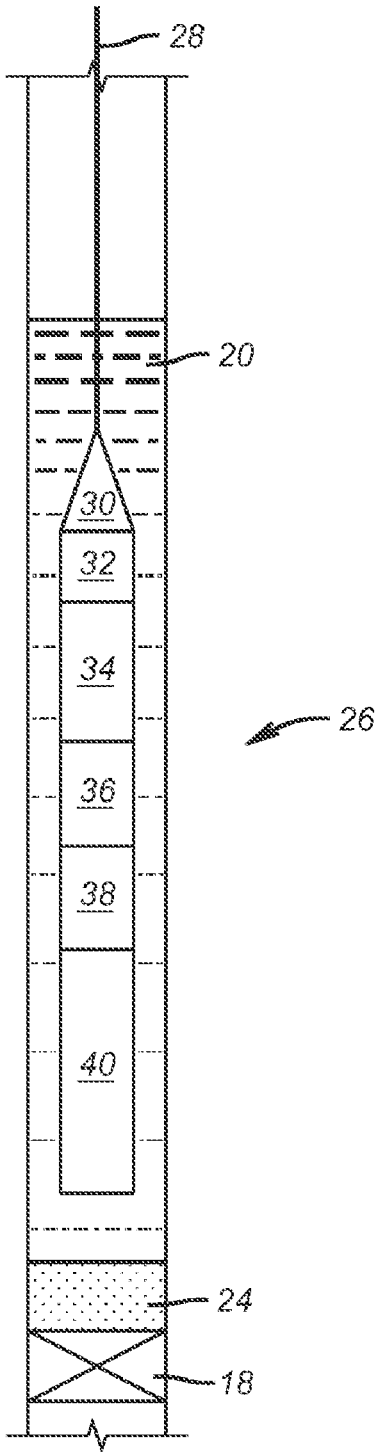
FIG. 2 is the view of FIG. 1 with the device lowered into position adjacent the debris to be removed.

FIG. 2 shows the tool 26 lowered into the water 20 on a slickline or non-conductive cable 28. The main features of the tool are a disconnect 30 at the lower end of the cable 28 and a control system 32 for turning the tool 26 on and off and for other purposes. A power supply, such as a battery 34, powers a motor 36, which in turn runs a pump 38. The modular debris removal tool 40 is at the bottom of the assembly.

While a cable or slickline 28 is preferred because it is a low cost way to rapidly get the tool 26 into the water 20, a wireline can also be used and surface power through the wireline can replace the onboard battery 34. The control system can be configured in different ways. In one version it can be a time delay energized at the surface so that the tool 26 will have enough time to be lowered into the water 20 before motor 36 starts running. Another way to actuate the motor 36 is to use a switch that is responsive to being immersed in water to complete the power delivery circuit. This can be a float type switch akin to a commode fill up valve or it can use the presence of water or other well fluids to otherwise complete a circuit. Since it is generally known at what depth the plug 18 has been set, the tool 26 can be quickly lowered to the approximate vicinity and then its speed reduced to avoid getting the lower end buried in the sand 24. The control system can also incorporate a flow switch to detect plugging in the debris tool 40 and shut the pump 38 to avoid ruining it or burning up the motor 36 if the pump 38 plugs up or stops turning for any reason. Other aspects of the control system 32 can include the ability to transmit electromagnetic or pressure wave signals through the wellbore or the slickline 28 such information such as the weight or volume of collected debris, for example.

Figure 3:
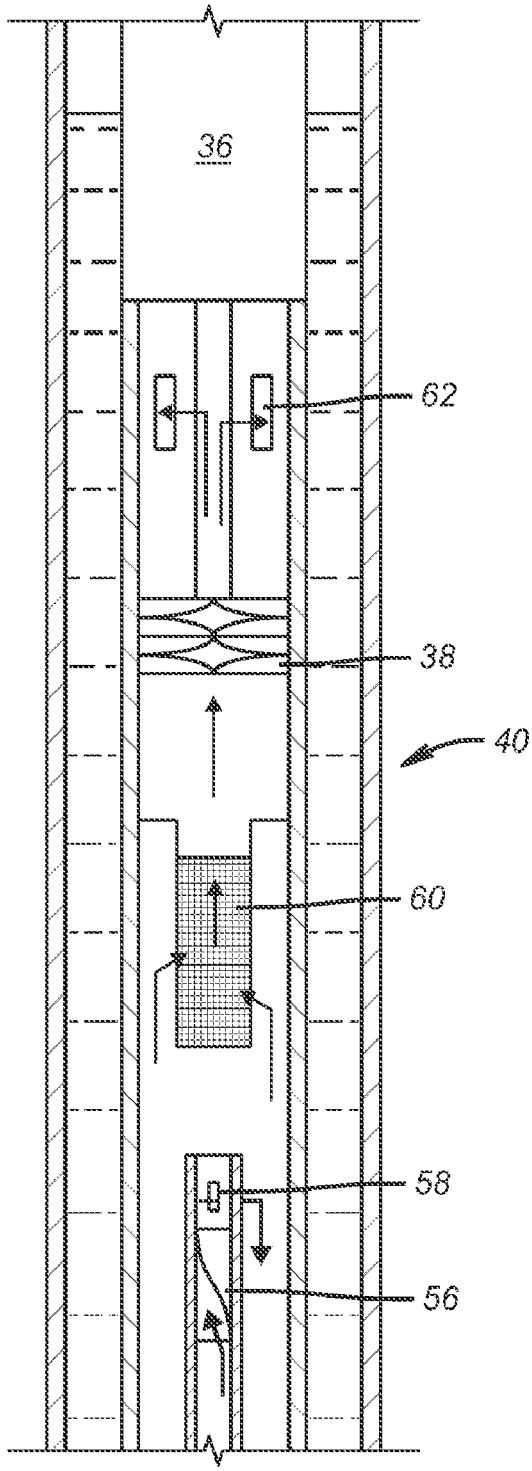
FIG. 3 is a detailed view of the debris removal device shown in FIG. 2.
Figure 4:
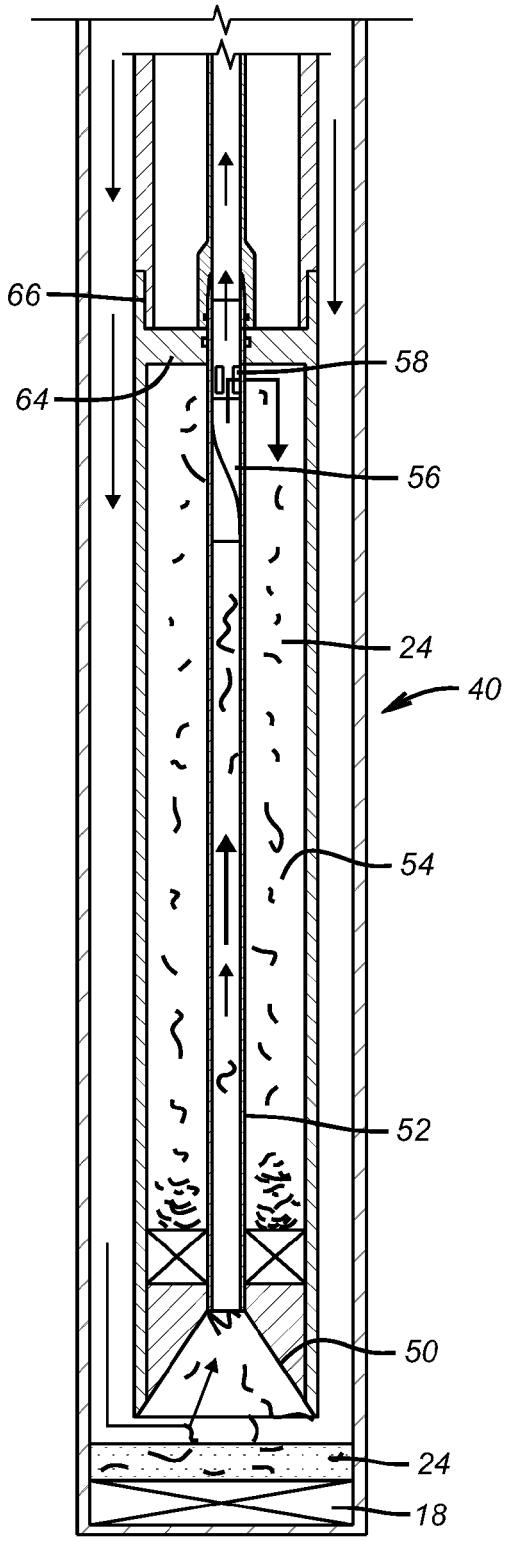
FIG. 4 is a lower end view of the device in FIG. 3 and illustrating the modular capability of the design.

Referring now to FIGS. 3 and 4, the inner details of the debris removal tool 40 are illustrated. There is a tapered inlet 50 leading to a preferably centered lift tube 52 that defines an annular volume 54 around it. Tube 52 can have one or more centrifugal separators 56 inside whose purpose is to get the fluid stream spinning to get the solids to the inner wall using centrifugal force. Alternatively, the tube 52 itself can be a spiral so that flow through it at a high enough velocity to keep the solids entrained will also cause them to migrate to the inner wall until the exit ports 58 are reached. Some of the sand or other debris will fall down in the annular volume 54 where the fluid velocity is low or non-existent. As best shown in FIG. 3, the fluid stream ultimately continues to a filter or screen 60 and into the suction of pump 38. The pump discharge exits at ports 62.

As shown in FIG. 4 the design can be modular so that tube 52 continues beyond partition 64 at thread 66 which defines a lowermost module. Thereafter, more modules can be added within the limits of the pump 38 to draw the required flow through tube 52. Each module has exit ports 58 that lead to a discrete annular volume 54 associated with each module. Additional modules increase the debris retention capacity and reduce the number of trips out of the well to remove the desired amount of sand 24.

Various options are contemplated. The tool 40 can be triggered to start when sensing the top of the layer of debris, or by depth in the well from known markers, or simply on a time delay basis. Movement uphole of a predetermined distance can shut the pump 38 off. This still allows the slickline operator to move up and down when reaching the debris so that he knows he's not stuck. The tool can include a vibrator to help fluidize the debris as an aid to getting it to move into the inlet 50. The pump 38 can be employed to also create vibration by eccentric mounting of its impeller. The pump can also be a turbine style or a progressive cavity type pump.

The tool 40 has the ability to provide continuous circulation which not only improves its debris removal capabilities but can also assist when running in or pulling out of the hole to reduce chances of getting the tool stuck.

While the preferred tool is a debris catcher, other tools can be run in on cable or slickline and have an on board power source for accomplishing other downhole operations. FIG. 2 is intended to schematically illustrate other tools 40 that can accomplish other tasks downhole such as honing or light milling. To the extent a torque is applied by the tool to accomplish the task, a part of the tool can also include an anchor portion to engage a well tubular to resist the torque applied by the tool 40. The slips or anchors that are used can be actuated with the on board power supply using a control system that for example can be responsive to a pattern of uphole and downhole movements of predetermined length to trigger the slips and start the tool.

Figure 5:
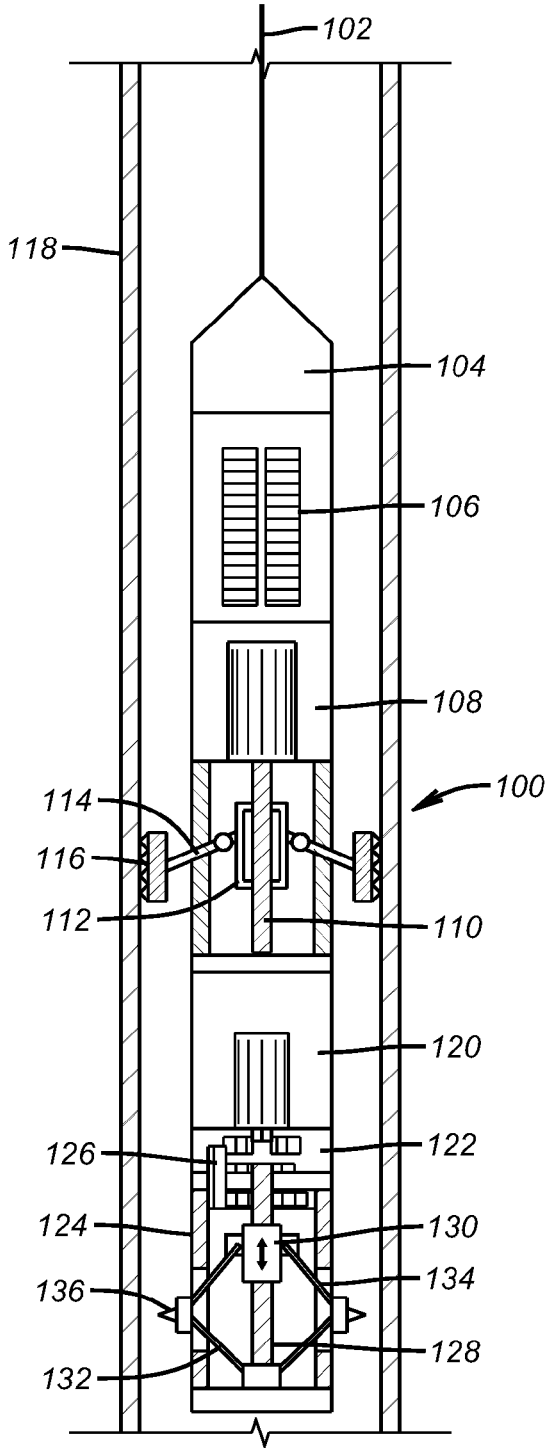
FIG. 5 is another application of a tool run on slickline to cut tubulars.

FIG. 5 illustrates a tubular cutter 100 run in on slickline 102. On top is a control package 104 that is equipped to selectively start the cutter 100 at a given location that can be based on a stored well profile in a processor that is part of package 104. There can also be sensors that detect depth from markers in the well or there can more simply be a time delay with a surface estimation as to the depth needed for the cut. Sensors could be tactile feelers, spring loaded wheel counters or ultrasonic proximity sensors. A battery pack 106 supplies a motor 108 that turns a ball shaft 110 which in turn moves the hub 112 axially in opposed directions. Movement of hub 112 rotates arms 114 that have a grip assembly 116 at an outer end for contact with the tubular 118 that is to be cut. A second motor 120 also driven by the battery pack 106 powers a gearbox 122 to slow its output speed. The gearbox 122 is connected to rotatably mounted housing 124 using gear 126. The gearbox 122 also turns ball screw 128 which drives housing 130 axially in opposed directions. Arms 132 and 134 link the housing 130 to the cutters 136. As arms 132 and 134 get closer to each other the cutters 136 extend radially. Reversing the rotational direction of cutter motor 120 retracts the cutters 136.

When the proper depth is reached and the anchor assemblies 116 get a firm grip on the tubular 118 to resist torque from cutting, the motor 120 is started to slowly extend the cutters 136 while the housing 124 is being driven by gear 126. When the cutters 136 engage the tubular 118 the cutting action begins. As the housing 124 rotates to cut the blades are slowly advanced radially into the tubular 118 to increase the depth of the cut. Controls can be added to regulate the cutting action. They controls can be as simple as providing fixed speeds for the housing 124 rotation and the cutter 136 extension so that the radial force on the cutter 136 will not stall the motor 120. Knowing the thickness of the tubular 118 the control package 104 can trigger the motor 120 to reverse when the cutters 136 have radially extended enough to cut through the tubular wall 118. Alternatively, the amount of axial movement of the housing 130 can be measured or the number of turns of the ball screw 128 can be measured by the control package 104 to detect when the tubular 118 should be cut all the way through. Other options can involve a sensor on the cutter 136 that can optically determine that the tubular 118 has been cut clean through. Reversing rotation on motors 108 and 120 will allow the cutters 136 to retract and the anchors 116 to retract for a fast trip out of the well using the slickline 102.

Figure 6:
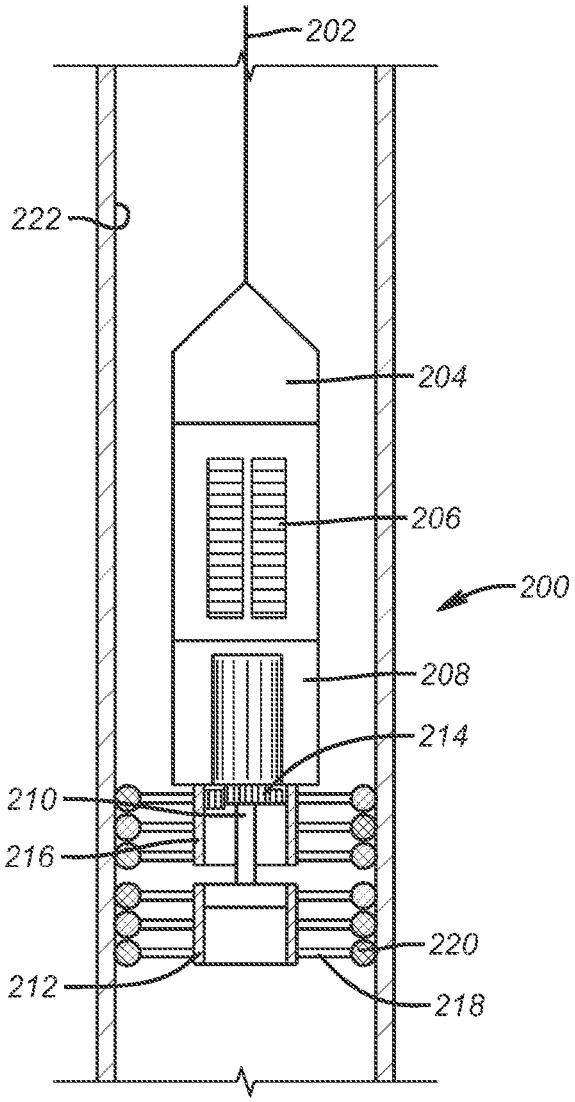
FIG. 6 is another application of a tool to scrape tubulars without an anchor that is run on slickline.
Figure 7:
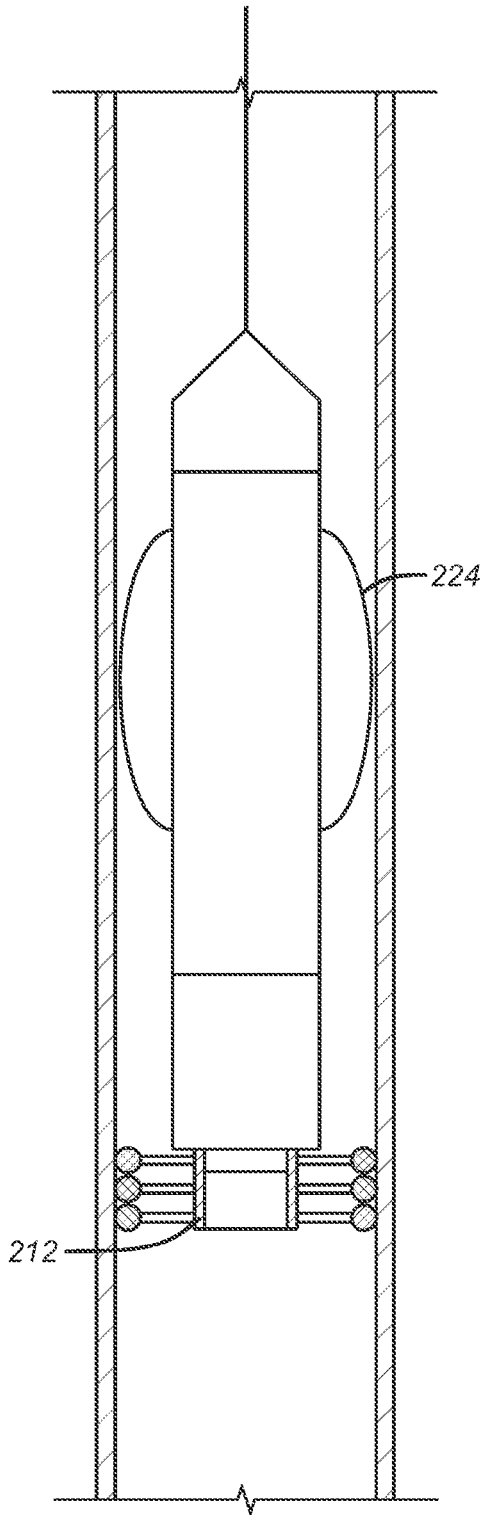
FIG. 7 is an alternative embodiment of the tool of FIG. 6 showing an anchoring feature used without the counter-rotating scrapers in FIG. 6.

FIG. 6 illustrates a scraper tool 200 run on slickline 202 connected to a control package 204 that can in the same way as the package 104 discussed with regard to the FIG. 5 embodiment, selectively turn on the scraper 200 when the proper depth is reached. A battery pack 206 selectively powers the motor 208. Motor shaft 210 is linked to drum 212 for tandem rotation. A gear assembly 214 drives drum 216 in the opposite direction as drum 212. Each of the drums 212 and 216 have an array of flexible connectors 218 that each preferably have a ball 220 made of a hardened material such as carbide. There is a clearance around the extended balls 220 to the inner wall of the tubular 222 so that rotation can take place with side to side motion of the scraper 200 resulting in wall impacts on tubular 222 for the scraping action. There will be a minimal net torque force on the tool and it will not need to be anchored because the drums 212 and 216 rotate in opposite directions. In the alternative, there can be but a single drum 212 as shown in FIG. 7. In that case the tool 200 needs to be stabilized against the torque from the scraping action. One way to anchor the tool is to use selectively extendable bow springs 224 that are preferably retracted for run in with slickline 202 so that the tool can progress rapidly to the location that needs to be scraped. Other types of driven extendable anchors could also be used and powered to extend and retract with the battery pack 206. The scraper devices 220 can be materials for the made in a variety of shapes and include diamonds or other scraping action.

Figure 8:
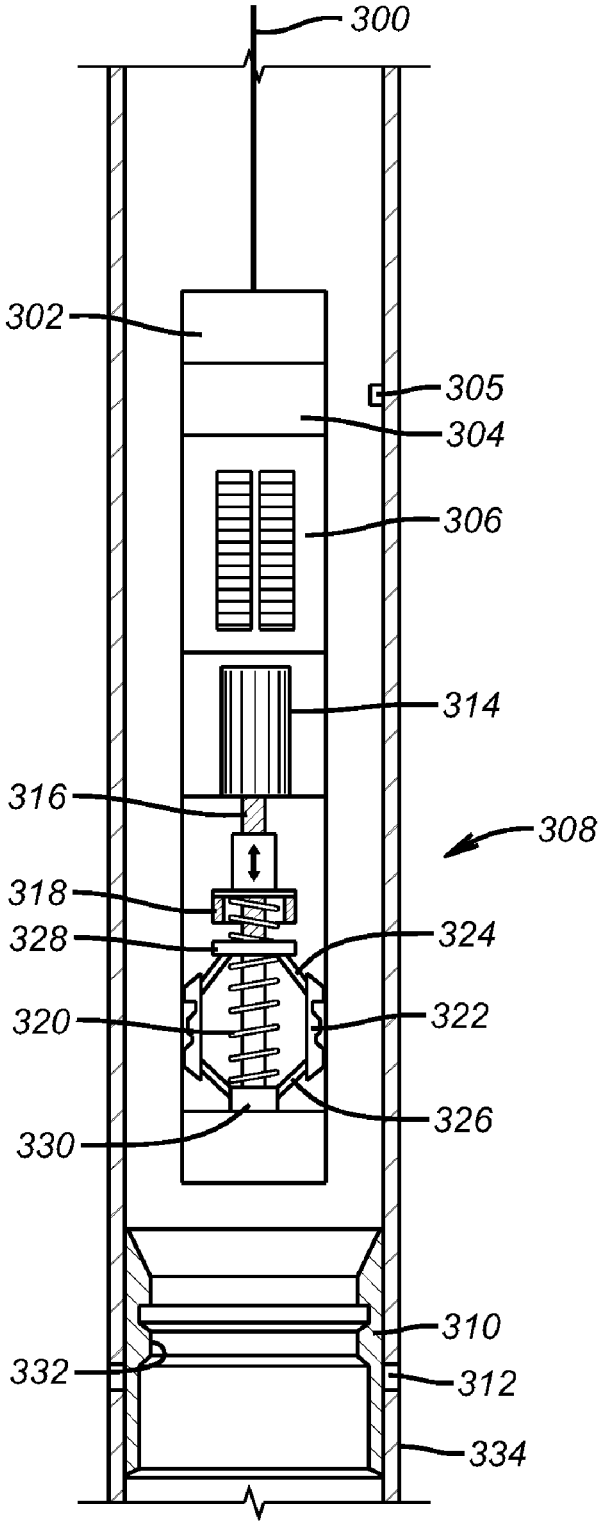
FIG. 8 is a section view showing a slickline run tool used for moving a downhole component.

FIG. 8 shows a slickline 300 supporting a jar assembly 302 that is commonly employed with slicklines to use to release a tool that may get stuck in a wellbore and to indicate to the surface operator that the tool is in fact not stuck in its present location. The Jar assembly can also be used to shift a sleeve 310 when the shifting keys 322 are engaged to a profile 332. If an anchor is provided, the jar assembly 302 can be omitted and the motor 314 will actuate the sleeve 310. A sensor package 304 selectively completes a circuit powered by the batteries 306 to actuate the tool, which in this case is a sleeve shifting tool 308. The sensor package 304 can respond to locating collars or other signal transmitting devices 305 that indicate the approximate position of the sleeve 310 to be shifted to open or close the port 312. Alternatively the sensor package 304 can respond to a predetermined movement of the slickline 300 or the surrounding wellbore conditions or an electromagnetic or pressure wave, to name a few examples. The main purpose of the sensor package 304 is to preserve power in the batteries 306 by keeping electrical load off the battery when it is not needed. A motor 314 is powered by the batteries 306 and in turn rotates a ball screw 316, which, depending on the direction of motor rotation, makes the nut 318 move down against the bias of spring 320 or up with an assist from the spring 320 if the motor direction is reversed or the power to it is simply cut off. Fully open and fully closed and positions in between are possible for the sleeve 310 using the motor 314. The shifting keys 322 are supported by linkages 324 and 326 on opposed ends. As hub 328 moves toward hub 330 the shifting keys 322 move out radially and latch into a conforming pattern 322 in the shifting sleeve 310. There can be more than one sleeve 310 in the string 334 and it is preferred that the shifting pattern in each sleeve 310 be identical so that in one pass with the slickline 300 multiple sleeves can be opened or closed as needed regardless of their inside diameter. While a ball screw mechanism is illustrated in FIG. 8 other techniques for motor drivers such as a linear motor can be used to function equally.

Figure 9:
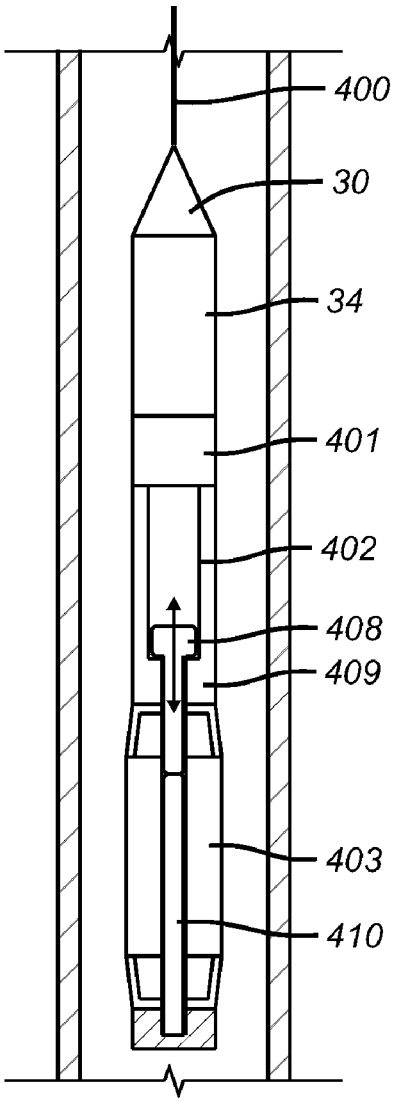
FIG. 9 is an alternative embodiment to the tool in FIG. 8 using a linear motor to set a packer.

FIG. 9 shows using a slickline 400 conveyed motor to set a mechanical packer 403. The tool 400 includes a disconnect 30, a battery 34, a control unit 401 and a motor unit 402. The motor unit can be a linear motor, a motor with a power screw or any other similar arrangements. When motor is actuated, the center piston or power screw 408 which is connected to the packer mandrel 410 moves respectively to the housing 409 against which it is braced to set the packer 403.

Figure 10:
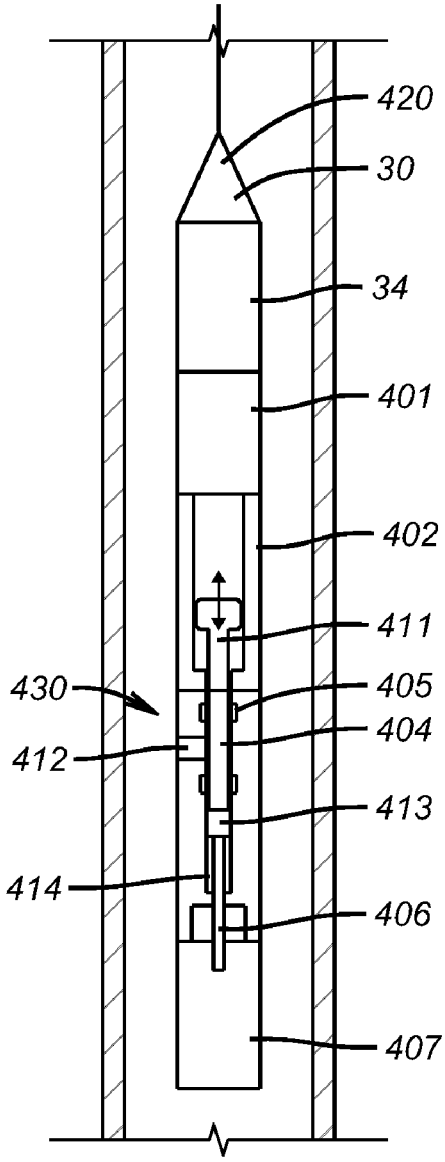
FIG. 10 is an alternative to FIG. 9 that incorporates hydrostatic pressure to set a packer.

In another arrangement, as illustrated in FIG. 10, a tool such as a packer or a bridge plug is set by a slickline conveyed setting tool 430. The tool 430 also includes a disconnect 30, a battery 34, a control unit 401 and a motor unit 402. The motor unit 402 also can be a linear motor, a motor with a power screw or other similar arrangements. The center piston or power screw 411 is connected to a piston 404 which seals off a series of ports 412 at run in position. When the motor is actuated, the center piston or power screw 411 moves and allow the ports 412 to be connected to chamber 413. Hydrostatic pressure enters the chamber 413, working against atmosphere chamber 414, pushing down the setting piston 413 and moving an actuating rod 406. A tool 407 thus is set.

Figure 11:
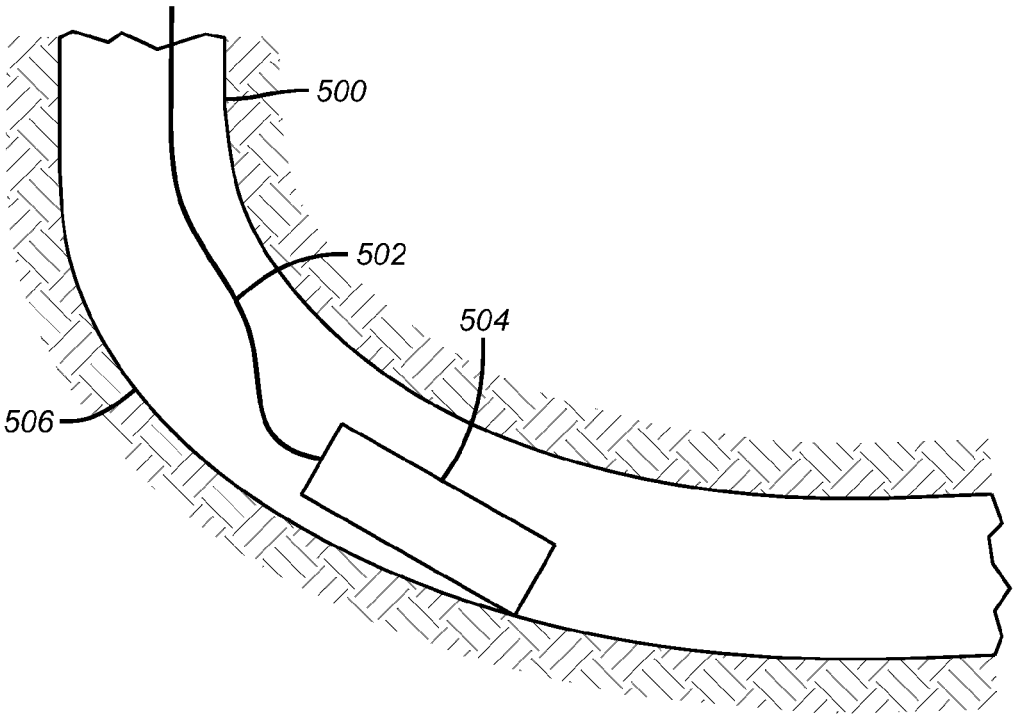
(PRIOR ART) FIG. 11
FIG. 11 illustrates the problem with using slicklines when encountering a wellbore that is deviated.

FIG. 11 illustrates a deviated wellbore 500 and a slickline 502 supporting a bottom hole assembly that can include logging tools or other tools 504. When the assembly 504 hits the deviation 506, forward progress stops and the cable goes slack as a signal on the surface that there is a problem downhole. When this happens, different steps have been taken to reduce friction such as adding external rollers or other bearings or adding viscosity reducers into the well. These systems have had limited success especially when the deviation is severe limiting the usefulness of the weight of the bottom hole assembly to further advance downhole.

Figure 12:
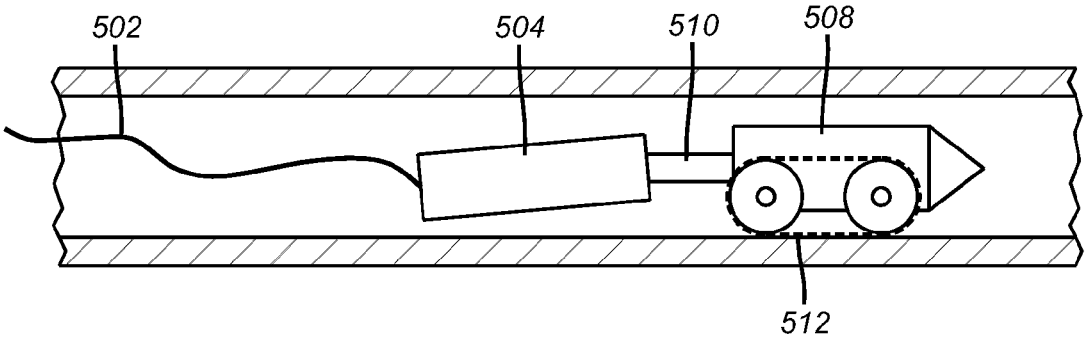
FIG. 12 illustrates how tractors are used to overcome the problem illustrated in FIG. 11.

FIG. 12 schematically illustrates the slickline 502 and the bottom hole assembly 504 but this time there is a tractor 508 that is connected to the bottom hole assembly (BHA) by a hinge or swivel joint or another connection 510. The tractor assembly 508 has onboard power that can drive wheels or tracks 512 selectively when the slickline 502 has a detected slack condition. Although the preferred location of the tractor assembly is ahead or downhole from the BHA 504 and on an end opposite from the slickline 502 placement of the tractor assembly 508 can also be on the uphole side of the BHA 504. At that time the drive system schematically represented by the tracks 512 starts up and drives the BHA 504 to the desired destination or until the deviation becomes slight enough to allow the slack to leave the slickline 502. If that happens the drive system 512 will shut down to conserve the power supply, which in the preferred embodiment will be onboard batteries. The connection 510 is articulated and is short enough to avoid binding in sharp turns but at the same time is flexible enough to allow the BHA 504 and the tractor 508 to go into different planes and to go over internal irregularities in the wellbore. It can be a plurality of ball and socket joints that can exhibit column strength in compression, which can occur when driving the BHA out of the wellbore as an assist to tension in the slickline. When coming out of the hole in the deviated section, the assembly 508 can be triggered to start so as to reduce the stress in the slickline 502 but to maintain a predetermined stress level to avoid overrunning the surface equipment and creating slack in the cable that can cause the cable 502 to ball up around the BHA 504. Ideally, a slight tension in the slickline 502 is desired when coming out of the hole. The mechanism that actually does the driving can be retractable to give the assembly 508 a smooth exterior profile where the well is not substantially deviated so that maximum advantage of the available gravitational force can be taken when tripping in the hole and to minimize the chances to getting stuck when tripping out. Apart from wheels 512 or a track system other driving alternatives are envisioned such a spiral on the exterior of a drum whose center axis is aligned with the assembly 508. Alternatively the tractor assembly can have a surrounding seal with an onboard pump that can pump fluid from one side of the seal to the opposite side of the seal and in so doing propel the assembly 508 in the desired direction. The drum can be solid or it can have articulated components to allow it to have a smaller diameter than the outer housing of the BHA 504 for when the driving is not required and a larger diameter to extend beyond the BHA 504 housing when it is required to drive the assembly 508. The drum can be driven in opposed direction depending on whether the BHA 504 is being tripped into and out of the well. The assembly 510 could have some column strength so that when tripping out of the well it can be in compression to provide a push force to the BHA 504 uphole such as to try to break it free if it gets stuck on the trip out of the hole. This objective can be addressed with a series of articulated links with limited degree of freedom to allow for some column strength and yet enough flexibility to flex to allow the assembly 508 to be in a different plane than the BHA 504. Such planes can intersect at up to 90 degrees. Different devices can be a part of the BHA 504 as discussed above. It should also be noted that relative rotation can be permitted between the assembly 508 and the BHA 504 which is permitted by the connector 510. This feature allows the assembly to negotiate a change of plane with a change in the deviation in the wellbore more easily in a deviated portion where the assembly 508 is operational.

The above description is illustrative of the preferred embodiment and many modifications may be made by those skilled in the art without departing from the invention whose scope is to be determined from the literal and equivalent scope of the claims below:

We claim:

1. A subterranean tool or tools shifter apparatus, comprising:

a housing and a slickline to suspend said housing downhole;

a power supply in said housing;

an anchor powered by said power supply;

a shifter assembly radially and axially driven with respect to said anchor by a motor in said housing powered by said power supply;

said motor actuated by at least one of manipulation of said slickline, the surrounding subterranean conditions, and a pressure wave.

2. The apparatus of claim 1, wherein:

said shifter assembly comprises a plurality of shifting keys powered by a ball screw driven by said motor.

3. The apparatus of claim 2, wherein:

said shifting keys are mounted on a linkage with a bias acting on said linkage to retract said keys radially inwardly where said shifting keys do not extend beyond said housing.

4. The apparatus of claim 3, further comprising:

said shifting keys selectively extendable and retractable a plurality of times for selective operation of the tool or tools.

5. The apparatus of claim 4, wherein:

said shifting keys can extend to different dimensions to operate different tools.

6. The apparatus of claim 1, wherein:

said motor comprises a linear motor.

7. The apparatus of claim 6, wherein:

said shifter assembly comprises an extending shaft assembly movable in at least one direction to engage the tool while said housing is in contact with the tool to offset a reaction force from shaft movement.

8. The apparatus of claim 7, wherein:

said shaft assembly comprises a setting piston to selectively open a port through said housing leading to a passage;

a actuating piston in said passage having said port on one side thereof and a variable volume chamber on an opposite side, whereupon movement of said setting piston well fluids from said port shift said actuating piston to reduce the volume of said chamber for setting of the tool.

9. The apparatus of claim 1, wherein:

said shifter assembly comprises an extending shaft assembly movable in at least one direction to engage the tool while said housing is in contact with the tool to offset a reaction force from shaft movement.

10. The apparatus of claim 9, wherein:

said shaft assembly comprises a setting piston to selectively open a port through said housing leading to a passage;

a actuating piston in said passage having said port on one side thereof and a variable volume chamber on an opposite side, whereupon movement of said setting piston well fluids from said port shift said actuating piston to reduce the volume of said chamber for setting of the tool.

11. The apparatus of claim 1, further comprising:

a sensor package that picks up a depth signal to selectively energize said motor with said power supply at a predetermined depth.

* * * * *